US011391420B2

(12) United States Patent
Chung et al.

(10) Patent No.: US 11,391,420 B2
(45) Date of Patent: Jul. 19, 2022

(54) DECORATIVE LIGHT STRING

(71) Applicants: Huang Cheng Chung, Dongguan (CN); Xu Xiang Yang, Yiwu (CN)

(72) Inventors: Huang Cheng Chung, Dongguan (CN); Xu Xiang Yang, Yiwu (CN)

(73) Assignee: Fourstar Group Inc., Taipei (TW)

( * ) Notice: Subject to any disclaimer, the term of this patent is extended or adjusted under 35 U.S.C. 154(b) by 0 days.

(21) Appl. No.: 17/095,924

(22) Filed: Nov. 12, 2020

(65) Prior Publication Data

US 2021/0062985 A1 Mar. 4, 2021

Related U.S. Application Data

(63) Continuation of application No. 16/441,276, filed on Jun. 14, 2019, now Pat. No. 10,845,012.

(51) Int. Cl.

| | |
|---|---|
| ***F21S 4/10*** | (2016.01) |
| ***F21V 3/02*** | (2006.01) |
| ***F21V 23/00*** | (2015.01) |
| *F21Y 115/10* | (2016.01) |

(52) U.S. Cl.

CPC ..... *F21S 4/10* (2016.01); *F21V 3/02* (2013.01); *F21V 23/001* (2013.01); *F21Y 2115/10* (2016.08)

(58) Field of Classification Search

CPC ..... F21S 4/10; F21V 23/001; F21V 3/02

See application file for complete search history.

(56) References Cited

U.S. PATENT DOCUMENTS

| | | | | |
|---|---|---|---|---|
| 5,666,021 | A ‡ | 9/1997 | Myson | H01R 33/09 313/31 |
| 6,371,629 | B1 ‡ | 4/2002 | Martinez | F21S 4/10 362/248 |
| 6,481,875 | B1 ‡ | 11/2002 | Bryant | F21V 17/06 362/12 |
| 6,648,492 | B1 ‡ | 11/2003 | Shih | F21V 21/092 362/24 |
| 9,033,548 | B2 * | 5/2015 | Tsai | F21V 23/06 362/249.06 |
| 9,853,256 | B2 ‡ | 12/2017 | Qin | H01M 10/425 |
| D817,212 | S ‡ | 5/2018 | Qin | D11/6 |
| D817,213 | S ‡ | 5/2018 | Qin | D11/6 |
| D819,480 | S ‡ | 6/2018 | Qin | D11/6 |
| D820,142 | S ‡ | 6/2018 | Qin | D11/6 |
| D828,774 | S ‡ | 9/2018 | Qin | D11/11 |
| D828,775 | S ‡ | 9/2018 | Qin | D11/11 |
| D828,776 | S ‡ | 9/2018 | Qin | D11/11 |
| D828,777 | S ‡ | 9/2018 | Qin | D11/11 |

(Continued)

*Primary Examiner* — Joseph L Williams

(74) *Attorney, Agent, or Firm* — Salter & Michaelson

(57) ABSTRACT

A light string of ornamental piece is provided wherein each ornamental piece includes electrical wiring that provides electrical power to a light element for each ornamental piece. The ornamental piece includes a shroud that is made up of mated shroud halves that are constructed and arranged to receive the electrical wiring and capture the light element therebetween. The shroud halves are each formed with a decorative base and integral neck having a top surface through which the electrical wiring extends. The light element is supported so as to be disposed within the base of the shroud so as to illuminate the base of the shroud.

19 Claims, 19 Drawing Sheets

(56) References Cited

U.S. PATENT DOCUMENTS

| | | | | |
|---|---|---|---|---|
| 10,064,461 | B2 ‡ | 9/2018 | Roos | A44C 15/0015 |
| 10,135,044 | B2 ‡ | 11/2018 | Qin | H01M 50/216 |
| 2010/0110668 | A1 ‡ | 5/2010 | Marlonia | F21V 23/0435 362/15 |
| 2010/0135024 | A1 ‡ | 6/2010 | Gier | F21V 3/02 362/294 |
| 2015/0089975 | A1 ‡ | 4/2015 | Paleschuck et al. | G09F 23/00 63/1.13 |
| 2017/0003003 | A1 ‡ | 1/2017 | Roos | A44C 15/005 |
| 2018/0008019 | A1 ‡ | 1/2018 | Qin | A44C 15/005 |
| 2018/0062126 | A1 ‡ | 3/2018 | Qin | H01M 10/425 |
| 2018/0320867 | A1 ‡ | 11/2018 | Chang | F21S 4/10 |
| 2019/0101253 | A1 ‡ | 4/2019 | Tsai | H01L 21/67144 |

* cited by examiner
‡ imported from a related application

DECORATIVE LIGHT STRING

FIELD OF THE INVENTION

The present invention relates in general to a decorative light string in which a series of ornamental shrouds, each having a lighting element, are connected by wiring. The present invention further relates to improved light string construction where the wiring is connected to each respective light element in a very simplified manner. The present invention relates even further to an improved light string employing individual LED elements in each shroud and wherein the light string, wiring and shrouds can be assembled efficiently.

BACKGROUND OF THE INVENTION

Light strings of the type described in connection with the present invention are decorative and meant to be controlled from a battery source by way of intercoupling wiring. An example of an existing light string is found in U.S. Pat. No. 10,064,461 to Roos. One of the drawbacks to existing light strings is the complexity related to the installation of the wiring as well as the complexity pertaining to the shroud construction itself.

Accordingly, it is an object of the present invention to provide an improved light string in which the wiring is readily connected, without the use of separate fasteners, to each respective shroud.

Another object of the present invention relates to improved light string construction where the wiring is connected to each respective light element in a very simplified and economical to assemble.

Still another object of the present invention is to provide an improved light string employing individual LED elements in each shroud and wherein the light string can be assembled efficiently and at a minimum cost.

SUMMARY OF THE INVENTION

To accomplish the foregoing and other objects, features and advantages of the present invention there is provided a light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base and integral neck having a top surface through which the electrical wiring extends, the light element being supported so as to be disposed within the base of the shroud so as to illuminate the base of the shroud.

In accordance with other aspects of the present invention each light element is comprised of an LED light source and a support post for supporting the LED light source, the LED light source being wider than the support post; including respective retaining collar halves at a bottom end of the neck and that are adapted to be joined in providing a complete retaining collar when the mated shroud halves are secured together, said retaining collar for fixedly holding the LED support post, and in turn the LED light source, in a fixed position within the shroud; wherein the top surface of the neck has an opening through which the wiring extends and wherein the opening is defined by like smaller slots in the respective shroud halves that together define the opening; wherein each collar half is secured to an inner surface of a wall defining the neck; wherein the respective shroud halves are interlocked by means of engaging posts and holes that are spaced apart around the base of the shroud, wherein at least one post and aligned hole is disposed above the LED light source in the neck of the shroud, and further including switch in the light string for selectively activating the LED light source from a battery.

In accordance with another embodiment of the present invention there is provided a light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base half and integral neck half, and a cap that is comprised of respective cap halves, each cap half for interlocking engagement with a respective neck half, and respective catch pieces adapted for engagement between the respective cap halves.

In accordance with other aspects of the present invention each light element is comprised of an LED light source and a support post for supporting the LED light source; wherein the top surface of the neck has an opening through which the wiring extends and wherein the opening is defined by like smaller slots in the respective cap halves that together define the opening; wherein the cap halves engage with the neck halves by means of a post and hole arrangement which firmly engages both cap halves with respective neck halves; wherein each neck half has a passage for receiving respective catch pieces; wherein the respective catch pieces include a catch on one of the cap halves and a ledge on the other of the cap halves; wherein the one cap half has a pair of opposed position catches and the other cap half has a pair of opposed position ledges; and wherein the one cap half includes an alignment post that engages with a hole in the associated neck half.

In accordance with still another embodiment of the present invention there is provided a light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base half and integral neck half, and a cap that is comprised of respective cap halves, each cap half for contact with a respective neck half, and a pair of support collars below the neck halves for supporting the electrical wiring and LED light source.

In accordance with still other aspects of the present invention respective catch pieces adapted for engagement between the respective cap halves; wherein the top surface of the neck has an opening through which the wiring extends and wherein the opening is defined by like smaller slots in the respective cap halves that together define the opening; wherein each neck half has a passage for receiving respective catch pieces; wherein the respective catch pieces include a catch on one of the cap halves and a ledge on the other of the cap halves; and wherein the one cap half has a pair of opposed position catches and the other cap half has a pair of opposed position ledges.

BRIEF DESCRIPTION OF THE DRAWINGS

It should be understood that the drawings are provided for the purpose of illustration only and are not intended to define the limits of the disclosure. The foregoing and other objects and advantages of the embodiments described herein will become apparent with reference to the following detailed description when taken in conjunction with the accompanying drawings in which.

DETAILED DESCRIPTION

Figure 1:
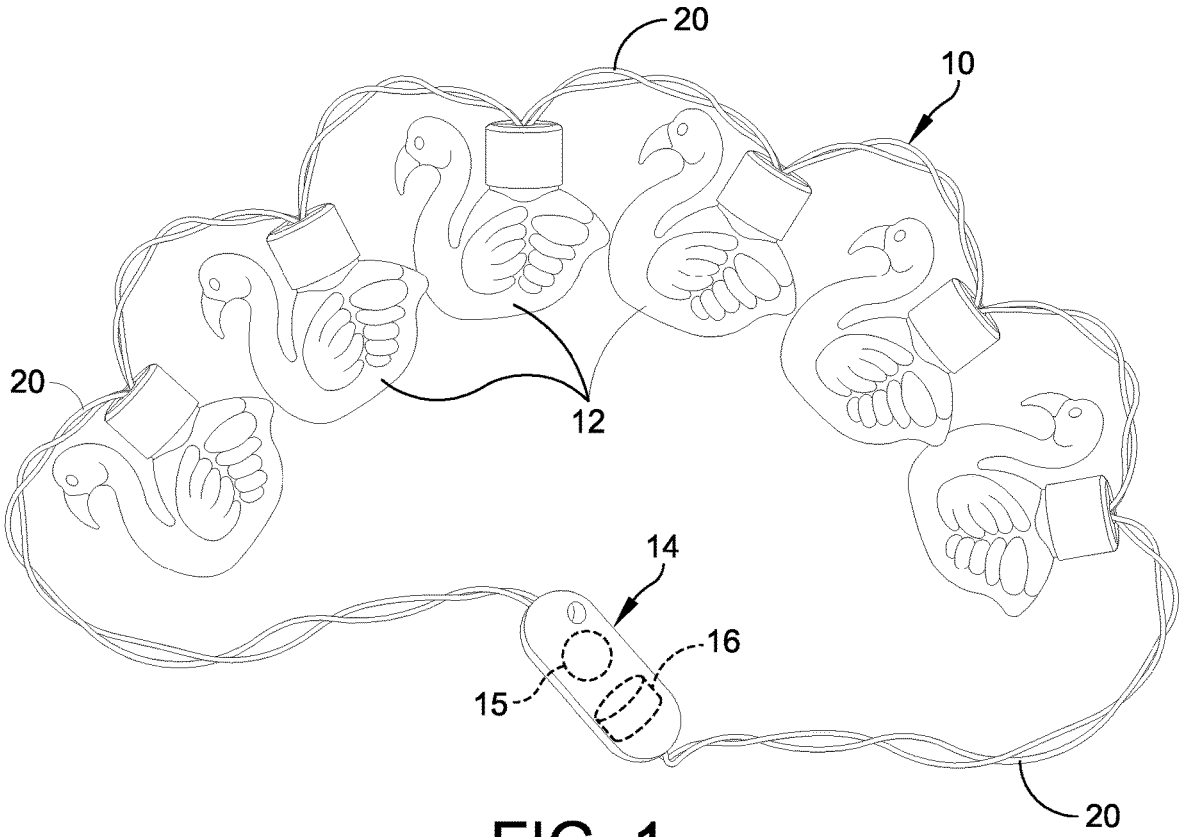
FIG. 1 is an illustration of a first embodiment of the present invention of a light string with shrouds that are in the form of a flamingo.
Figure 2:
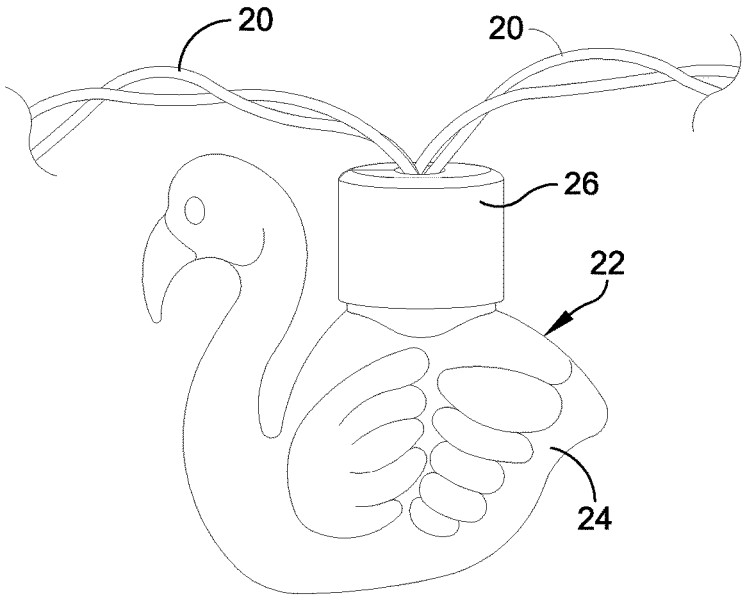
FIG. 2 is a side elevation view of a single shroud construction.

There are disclosed multiple embodiments of the present invention. In all of these embodiments there is provided interconnected wiring and some type of a light control device that includes a battery for operating light elements in each of the separate ornamental pieces or shrouds. In all of the embodiments presented herein, the wiring is entered at a top of the shroud such as illustrated in FIGS. 1 and 2. In one embodiment the wiring is captured by employing separate shroud halves. In another embodiment of the invention a retaining cap is provided where the retaining cap is also provided in halves and engages with a neck of the ornamental piece.

Figure 3:
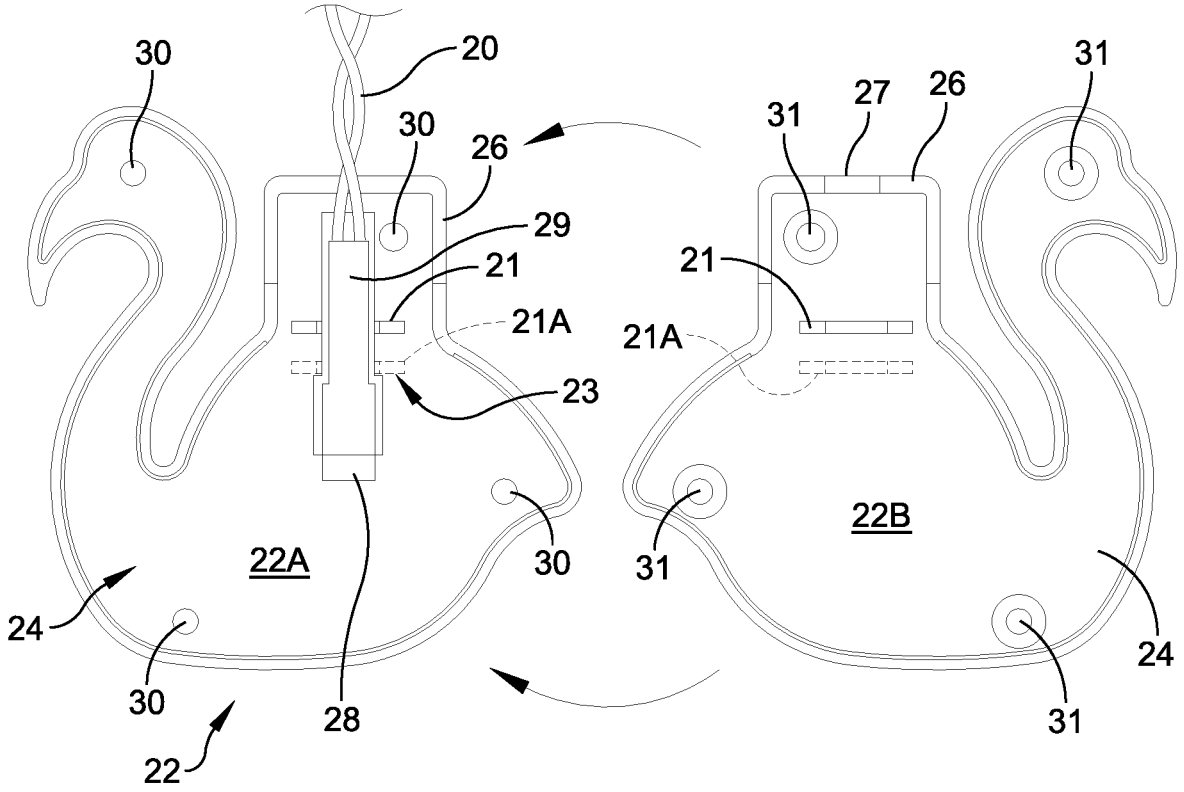
FIG. 3 illustrates separate halves of the shroud in an opened position.
Figure 4:
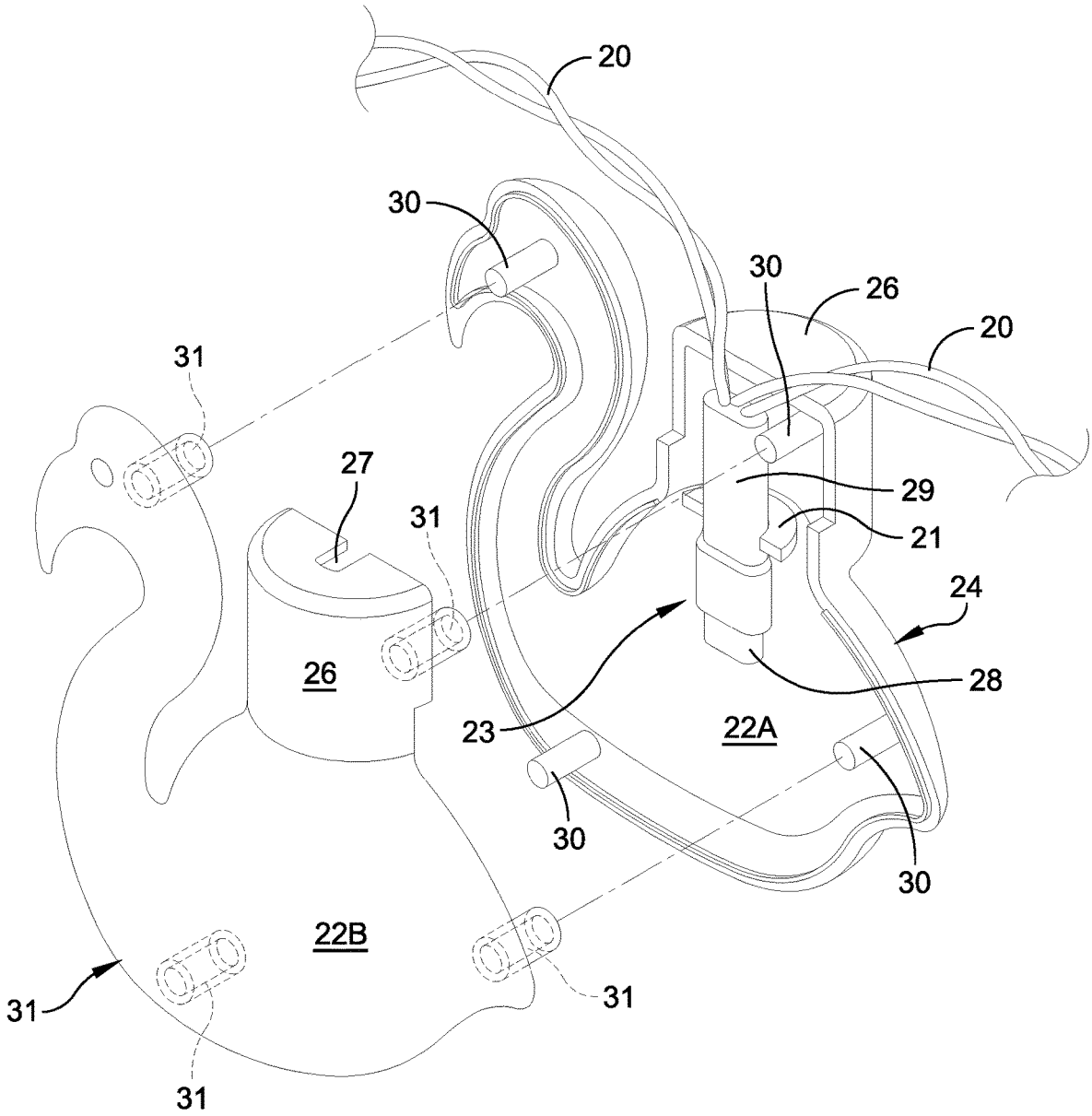
FIG. 4 is an exploded perspective view of the shroud construction illustrated in FIGS. 2 and 3.

A first embodiment of the present invention is illustrated in FIGS. 1-4. FIG. 1 is an illustration of a first embodiment of the present invention of a light string with shrouds that are in the form of a "flamingo". FIG. 2 is a side elevation view of a single shroud construction. FIG. 3 illustrates separate halves of the shroud in an opened position. FIG. 4 is an exploded perspective view of the shroud construction illustrated in FIGS. 2 and 3.

In this first embodiment of the present invention there is provided a light string 10 that is comprised of a series of ornamental pieces 12 that are each in the form of a hollow shroud construction. Various configurations can be used as far as the shroud is concerned. In the first embodiment illustrated in FIGS. 1-4, the shroud is in the form of a "flamingo".

FIG. 1 also illustrates that the wiring 20 connects to a light control member 14 which is schematically illustrated as including a switch at 15 and a battery at 16. The switch simply controls the circuit so that the LEDs within each shroud can be illuminated or not. Moreover, one can provide a simple timing circuit so that the switch can control a number of different cycles of the LEDs including a steady illumination or a pulse illumination.

FIGS. 2-4 illustrate the shroud 22 as comprised of separate shroud halves 22A and 22B. Each shroud half is also comprised of a base portion 24 and a neck portion 26. The neck portion 26 is provided with an opening 27 that may be provided in either or both halves 22A, 22B. FIGS. 3 and 4 also illustrate the lighting element by means of the LED 28 and the support 29. The wiring 20 connects by way of the support 29 to power the LED 28. In this first embodiment, the shroud halves are provided with a post on one side and an accommodating hole on the other side. Reference may be made to FIG. 4 and the post or pin 30 associated with the shroud half 22A as well as the holes 31 associated with the shroud half 22B. In the embodiment shown in FIG. 4 at least four spaced apart pins/holes are provided.

The lighting element is preferably secured by means of a retaining collar 21, portions of which are provided in each shroud half such as illustrated in FIG. 3. In a preferred embodiment there is also provided a lower collar 22A depicted in dotted outline in FIG. 3. Once the shroud halves are assembled together by engaging the post 30 with the holes 31, then the retaining collar halves 21 engage and firmly support the lighting element in place. FIG. 3 also shows a second collar 21A spaced below the upper collar 21.

Figure 5:
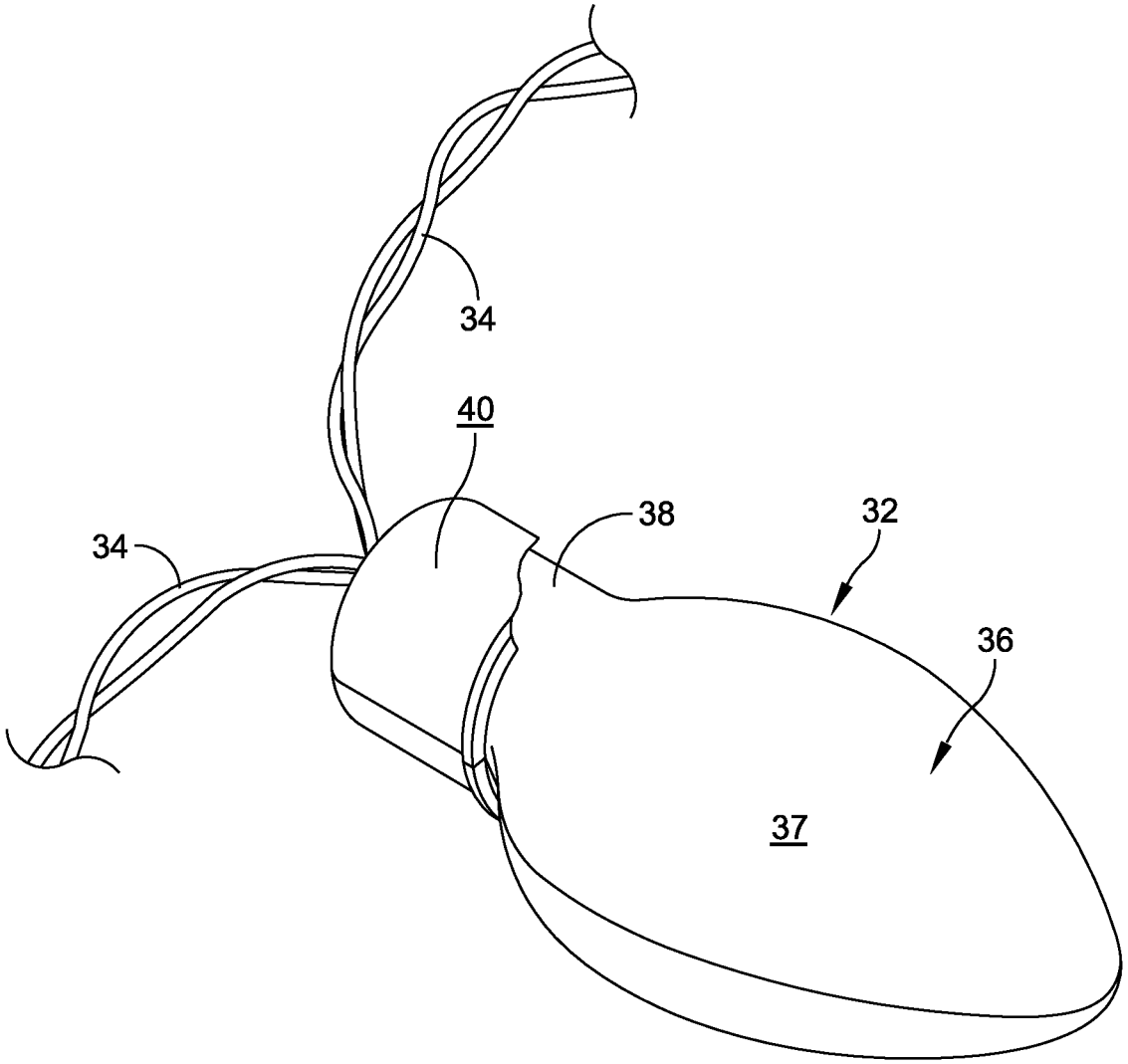
FIG. 5 is a perspective view of a second embodiment of the present invention in which the shroud is in the form of a bulb.
Figure 6:
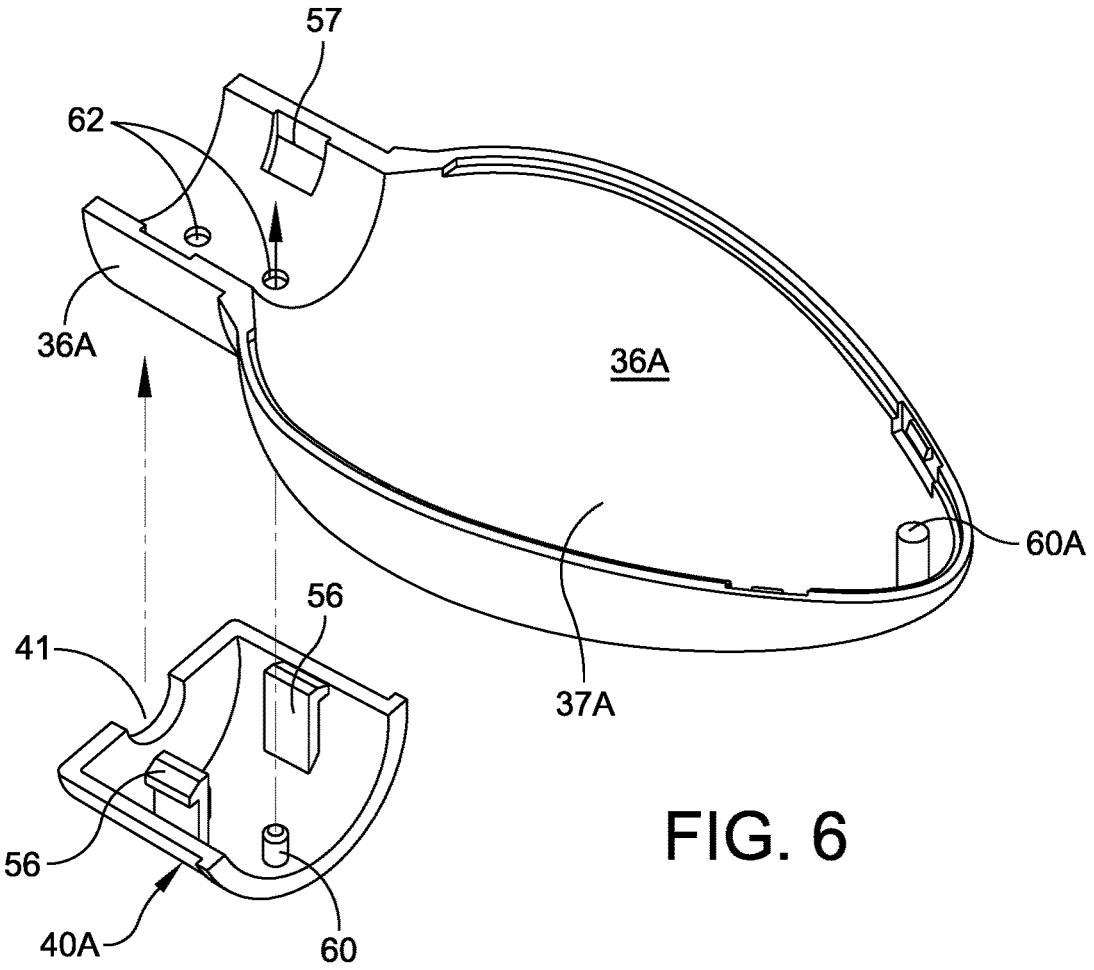
FIG. 6 is a perspective view of one half of the shroud illustrated in FIG. 5 with the cap portion exploded away from the shroud.
Figure 7:
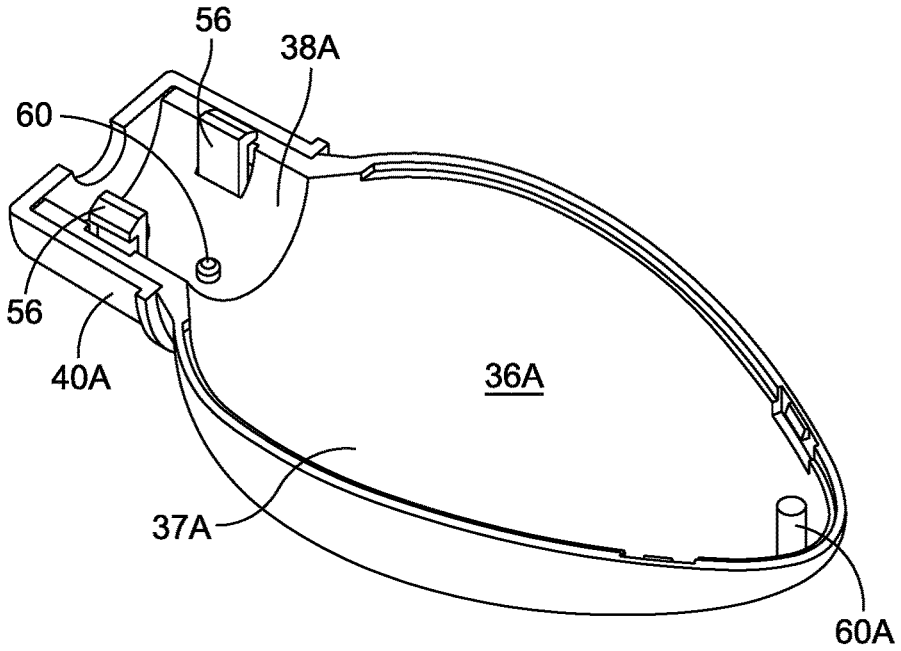
FIG. 7 is a perspective view of the same shroud half illustrated in FIGS. 5 and 6 with the half cap attached.
Figure 8:
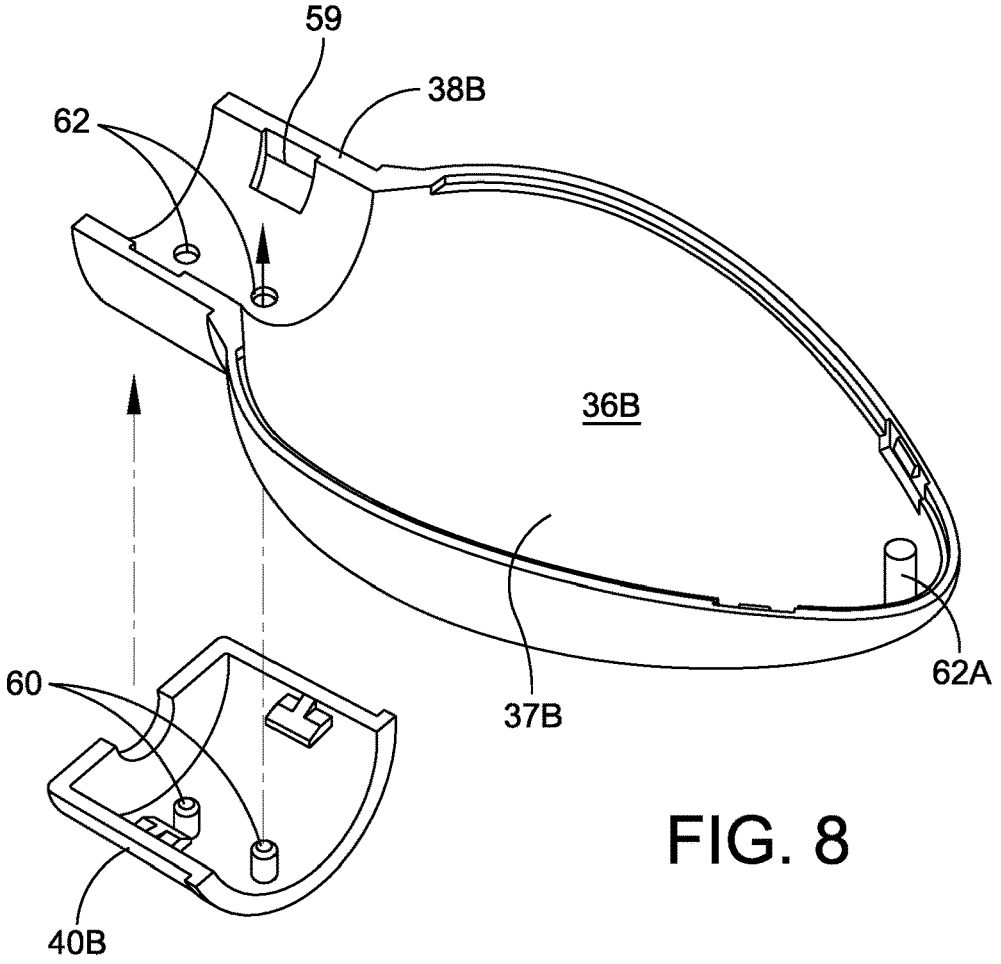
FIG. 8 is a perspective view of the other half of the shroud with half of the cap exploded away.
Figure 9:
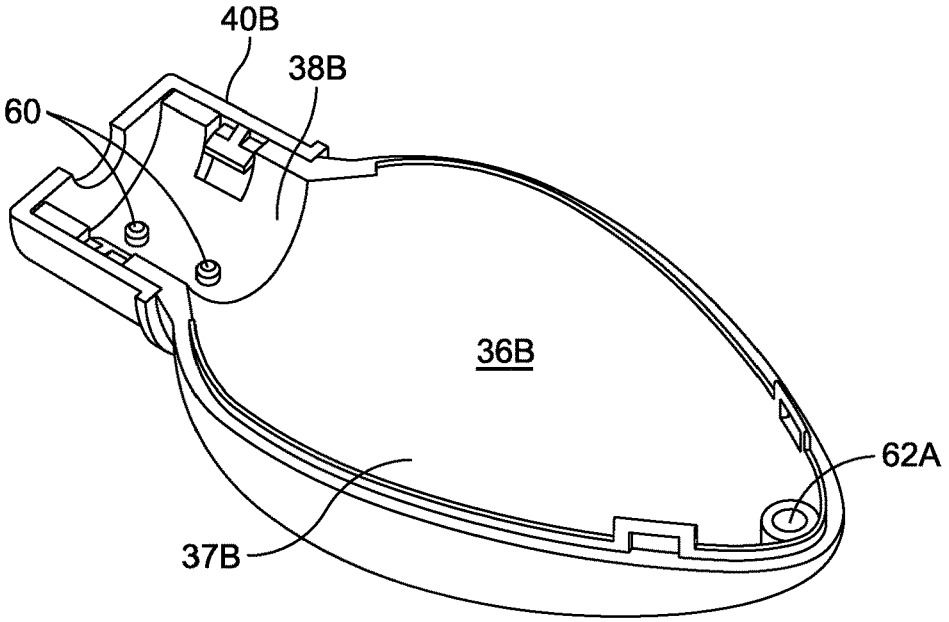
FIG. 9 is a perspective view of the other half with the cap assembled.
Figure 10:
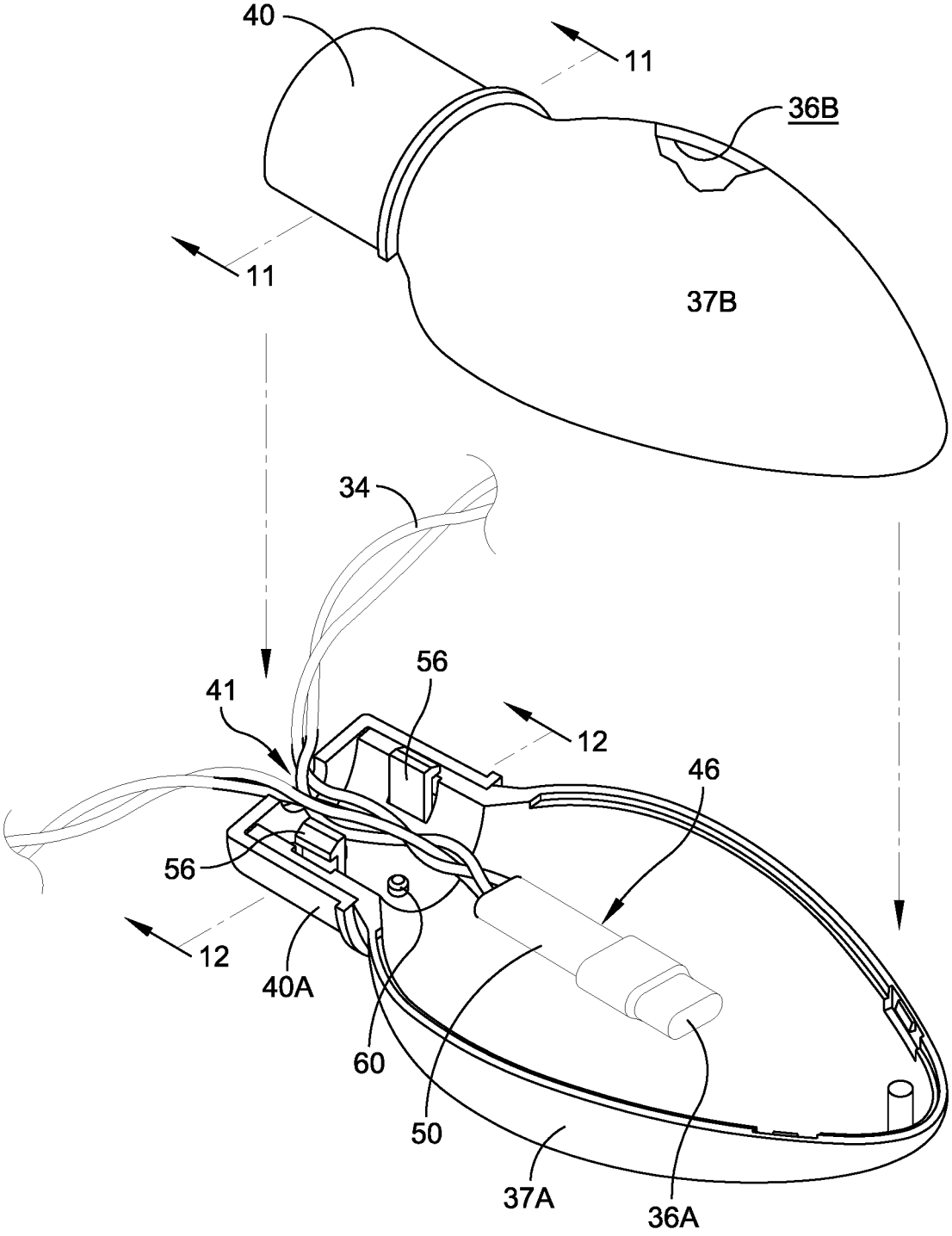
FIG. 10 is an exploded perspective view showing the wiring and light element installed between the cap halves.
Figure 11:
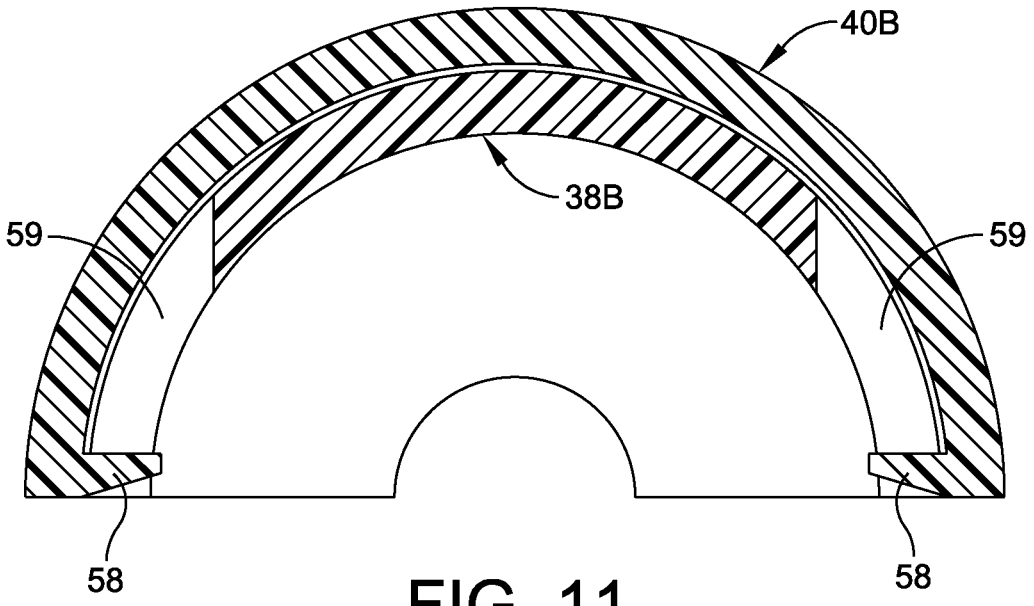
FIG. 11 is a cross-sectional view taken along line 11-11 of FIG. 10.
Figure 12:
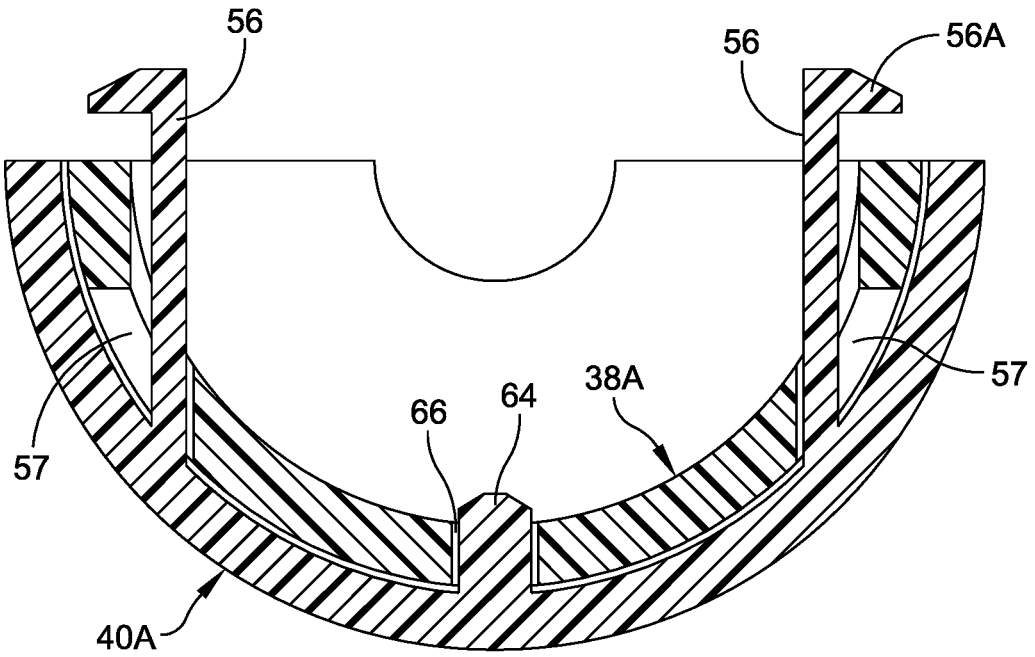
FIG. 12 is a cross-sectional view taken along line 12-12 of FIG. 10.
Figure 13:
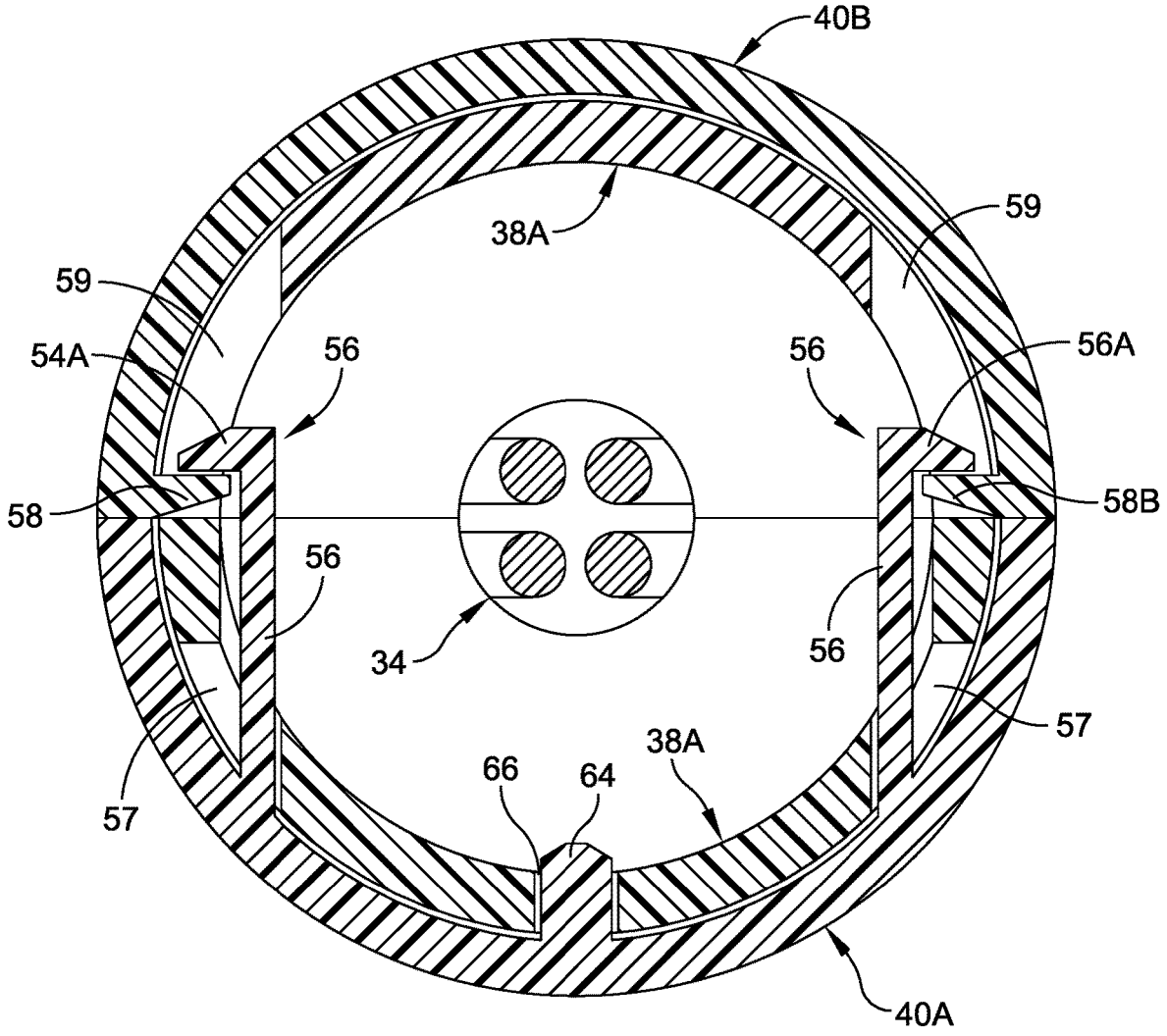
FIG. 13 is a cross-sectional view with both halves interengaged.

Reference is now made to a second embodiment of the present invention illustrated in FIGS. 5-13. FIG. 5 is a perspective view of the second embodiment of the present invention in which the shroud is in the form of a bulb. FIG. 6 is a perspective view of one half of the shroud illustrated in FIG. 5 with the cap portion exploded away from the shroud. FIG. 7 is a perspective view of the same shroud half illustrated in FIGS. 5 and 6 with the half cap attached. FIG. 8 is a perspective view of the other half of the shroud with half of the cap exploded away. FIG. 9 is a perspective view of the other half with the half cap assembled. FIG. 10 is an exploded perspective view showing the wiring and light element installed between the cap halves. FIG. 11 is a cross-sectional view taken along line 11-11 of FIG. 10. FIG. 12 is a cross-sectional view taken along line 12-12 of FIG. 10. FIG. 13 is a cross-sectional view with both halves interengaged. In FIGS. 5-13 only a single shroud is shown but it is understood that a series of shrouds or ornamental pieces are provided coupled by way of the wiring 34 as a manner described in FIG. 1. In the second embodiment of the present invention there is illustrated an ornamental piece 32 that is in the form of a shroud 36. FIG. 5 illustrates the wiring 34 that connects to the shroud 36.

The shroud 36 includes a shroud base 37 and a neck 38. Refer to FIG. 6 that shows a first shroud half 36A that has a neck half 38A. FIG. 6 shows the cap half 40A exploded away from the neck half 38A. FIG. 7 illustrates the cap half 40A engaged with the neck half 38A. For this purpose there are provided alignment posts 60 that engage with holes 62 with a firm fit between them. FIG. 7 also illustrates the catch 56.

Reference is now made to FIG. 8 for an illustration of the other shroud half 36B which includes the base 37B and the neck portion 38B. FIG. 8 illustrates the cap half 40B exploded away from the neck 38B. FIG. 9 illustrates the cap half 40B engaged with the neck 38B by means of the engaging posts 60 and holes 62. In order to secure the shroud halves together, there is also provided a securing post 60A and a corresponding hole 62A as illustrated in FIGS. 6-9. Spaced apart posts or pins and corresponding holes may be provided about the interior of the shroud as shown in the embodiment of FIG. 3.

Reference is now also made to the exploded view of FIG. 10 which shows the base half 37A and overlying that the other half 37B. FIG. 10 illustrates the pair of catches 56 that will be used for engaging the halves in an assembled manner. In FIG. 10 there is provided an opening 41 through which the wiring 34 extends to the light element 46. The light element 46 includes the support post 50 and the LED 48. Additional retaining collars may also be provided about the support post 50.

Reference is now made to the cross-sectional views of FIGS. 11-13. The cross-sectional views of FIGS. 11 and 12 illustrate respectively the necks 38B and 38A of the shroud as well as the configuration of the cap. In FIG. 12 the cap half 40A is illustrated as having extended therefrom, catch elements 56 which terminate in an end catch member 56A. The other cap half 40B as illustrated in FIG. 11 includes the ledge 58. Reference to FIG. 13 clearly illustrates the manner in which the end catch piece 56A engages with the respective ledge 58. Once the two halves are assembled together, the entire LED lighting element and wiring are retained in place without the use of any separate attachment pieces. FIGS. 12 and 13 also show an interlocking engagement by means of the pin 64 extending inwardly from the cap half 40A and a corresponding hole 66 in the neck half 40A.

Figure 14:
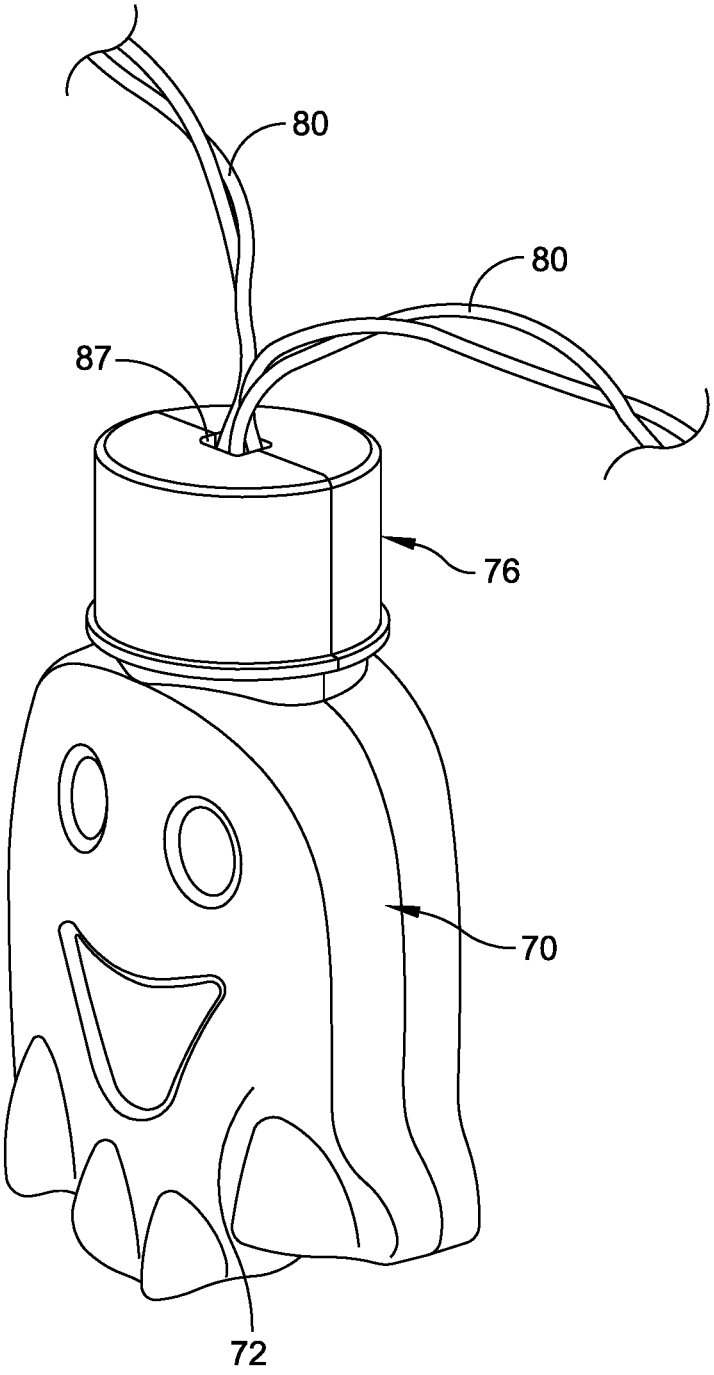
FIG. 14 is a perspective view of a third embodiment of the present invention in the form of a ghost.
Figure 15:
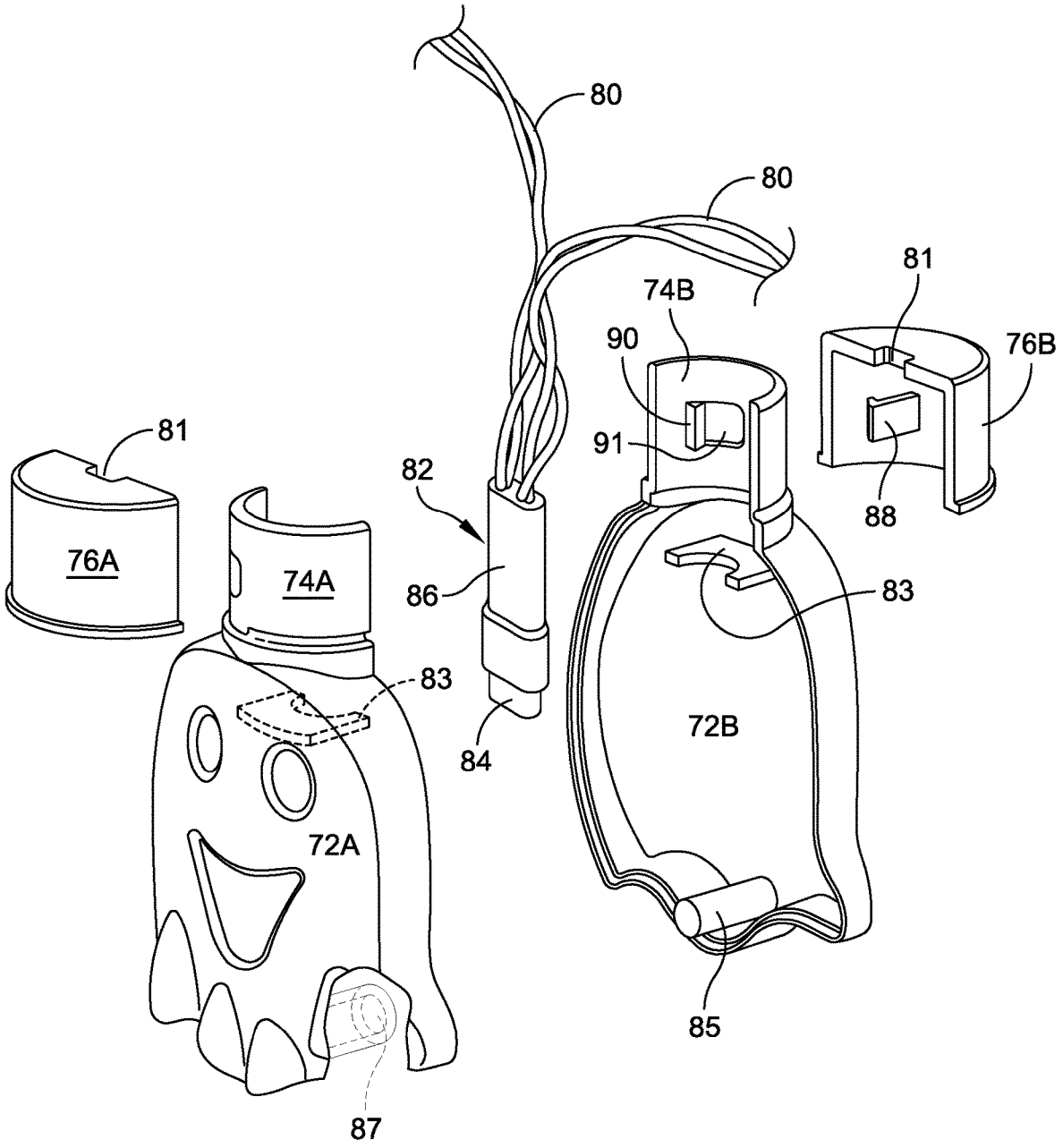
FIG. 15 is an exploded perspective view of the embodiment illustrated in FIG. 14.
Figure 16:
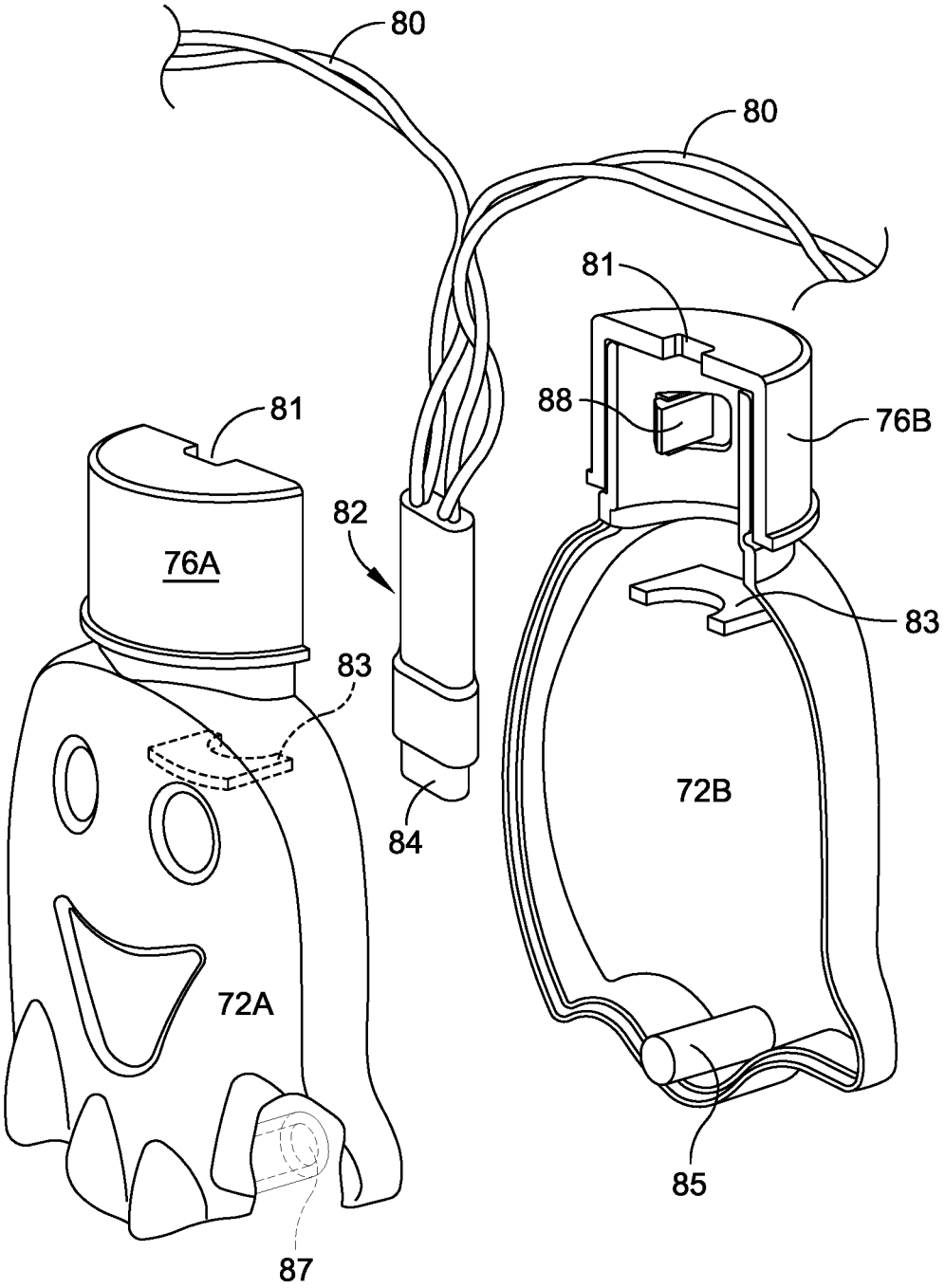
FIG. 16 is an exploded perspective view with the cap halves engaged with the neck of the shroud.
Figure 17:
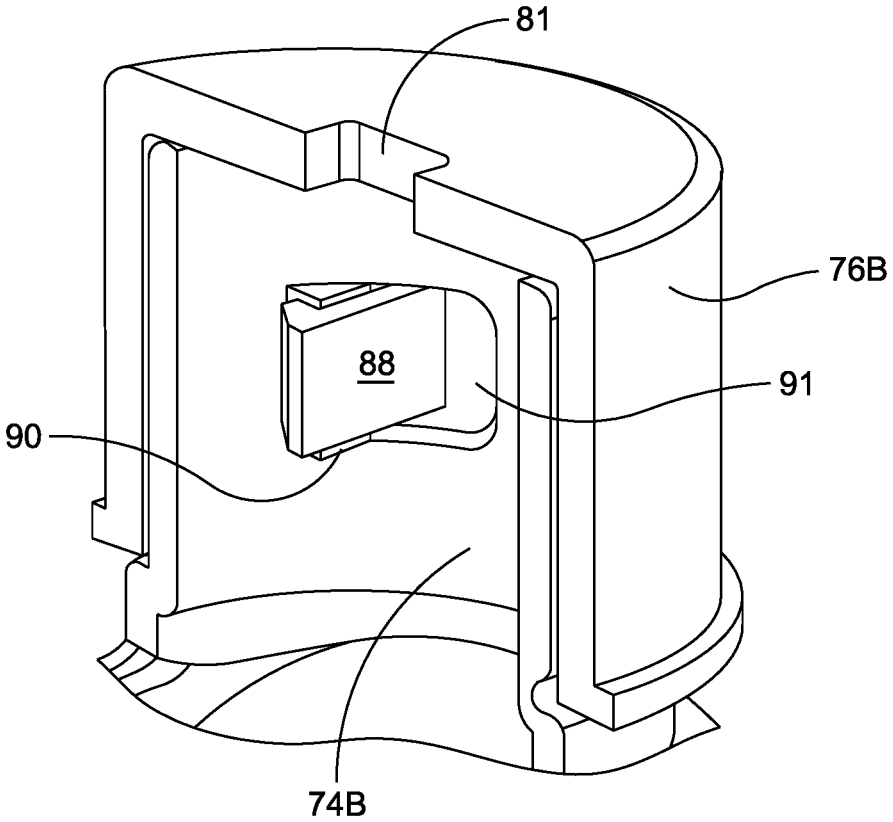
FIG. 17 is an enlarged perspective view at the cap end neck.
Figure 18:
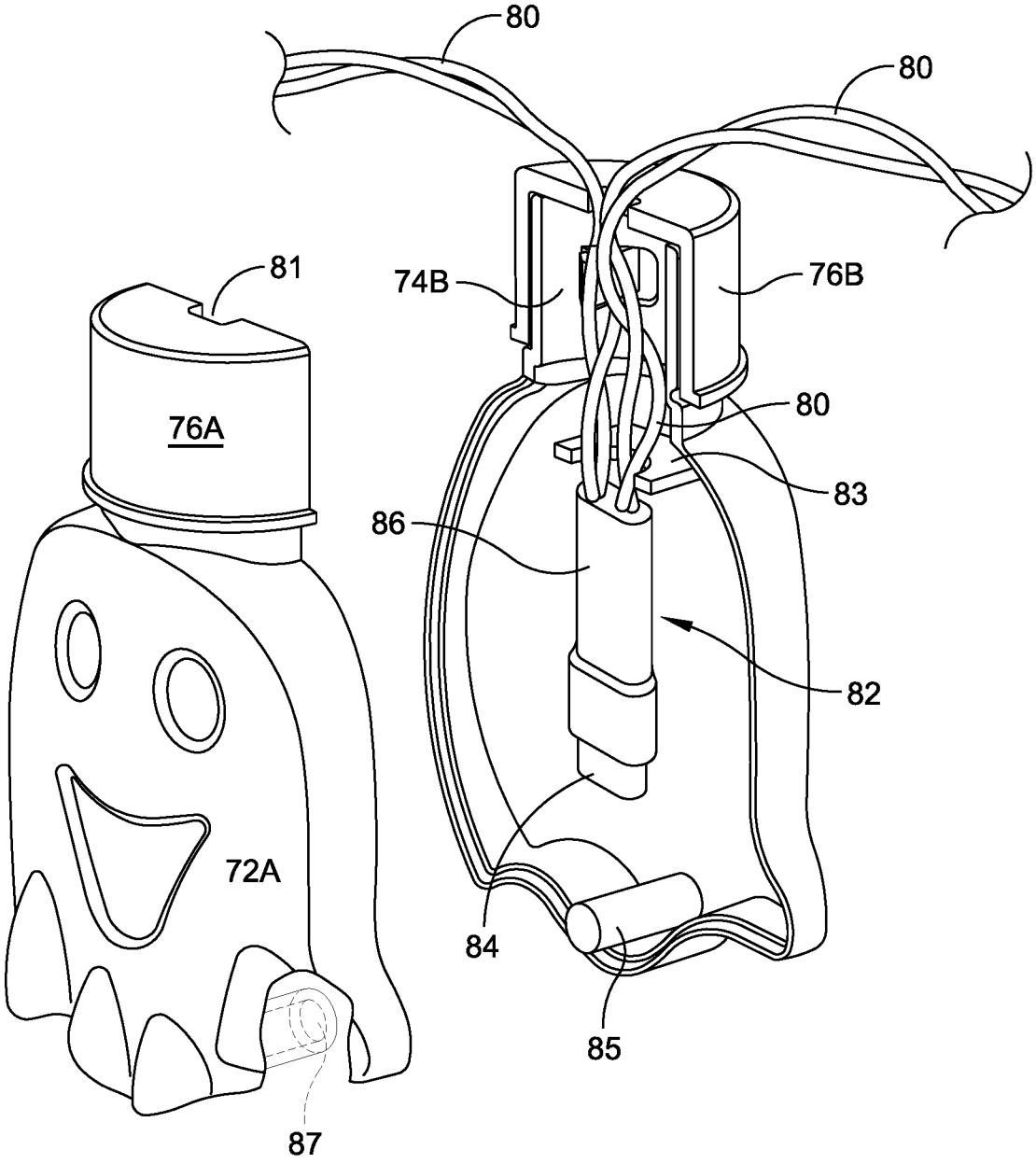
FIG. 18 is an exploded perspective view of a fourth embodiment of the present invention.

Reference is now made to a third embodiment of the present invention illustrated in FIG. 14. FIG. 14 is a perspective view in the form of a "ghost". FIG. 15 is an exploded perspective view of the embodiment illustrated in FIG. 14. FIG. 16 is an exploded perspective view with the cap halves engaged with the neck of the shroud. FIG. 17 is an enlarged perspective view at the cap end neck. This embodiment includes a shroud 70 that is comprised of a shroud base 72 and a neck 74. FIG. 14 illustrates the wiring 80 entering through the cap 76 at the passage 81. Reference may now be made to FIGS. 15-18 that illustrate the shroud bases 72A and 72B as well as the shroud neck halves 74A and 74B. FIG. 15 also illustrates the cap half 76A and the other cap half 76B both of which supports a catch 88. In the embodiment of FIG. 15 there may also be provided the retaining collar 83, one associated with each base. The lighting element 82 is shown disposed between the shroud halves and is comprised of a support piece 86 for the LED 84. The exploded perspective view of FIG. 18 in particular shows the manner in which the retaining collar 83 supports the light element 82. The wiring 80 extends through a top wall aperture in the caps 76A, 76B. The collars 83 are provided in both shroud halves.

In the embodiment illustrated in FIGS. 14-18, the catch 88 is for engagement with a ledge 90 which is adjacent to the hole 91 as illustrated in FIG. 15. A similar catch and ledge arrangement may be associated with the other neck half 74A and cap half 76A. The two shroud halves may be interconnected such as by means of the pin 85 and associated hole 87. The pin 85 is illustrated as extending from an inner surface of the shroud base 72B extending into a hole 87 in the shroud base 72A. In addition to this pin 85, there may be additional pin or post/hole arrangements disposed spaced about the shroud in a manner similar to that illustrated in the first embodiment in FIGS. 1-4.

Figure 19:
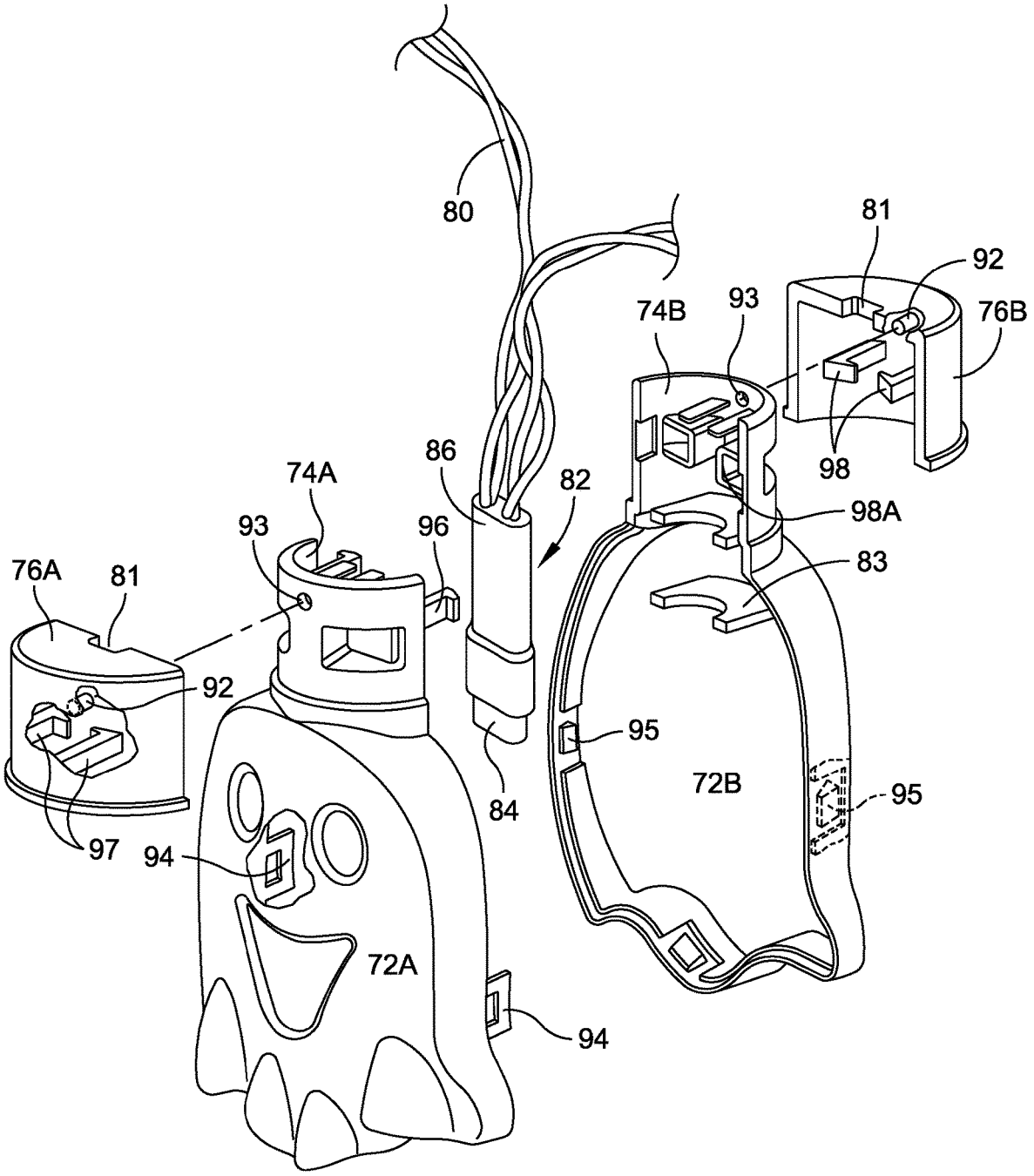
FIG. 19 is an exploded perspective view showing the shroud halves and the cap halves.

Reference is now made to a final embodiment of the present invention illustrated in FIGS. 19-25. In this embodiment the shroud is also in the form of a "ghost" and in this embodiment many of the same reference characters are used as described with the embodiment illustrated in FIGS. 14-18. Thus, the shroud halves each include a shroud half base 72A, 72B and a shroud half neck 74A, 74B. Also illustrated in, for example, FIG. 19 there are provided cap halves 76A and 76B. In this embodiment the top wall of each half is provided with a passage indicated at 81. FIG. 19 also illustrates the light element 82 as including the support 86 for the LED 84 along with the wiring 80 that connects through the support 86 to the LED device 84.

In the embodiment illustrated in FIG. 19, a somewhat different arrangement is used for interconnecting the two shroud halves, this may include on one side a loop 94 that can engage with a tab 95. Loop 94 has a center hole that can engage over the tab 95. This embodiment may also be provided with one or more sets of retaining collars 83 as in the first embodiment previously described.

Figure 20:
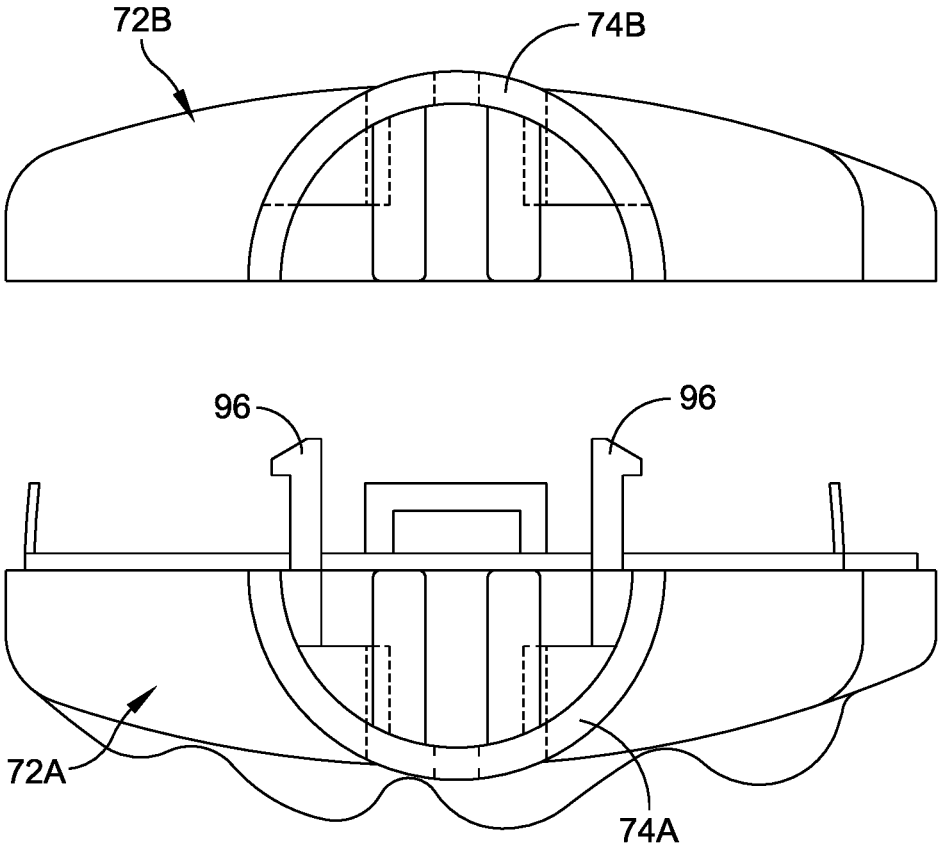
FIG. 20 is a top plan view.
Figure 21:
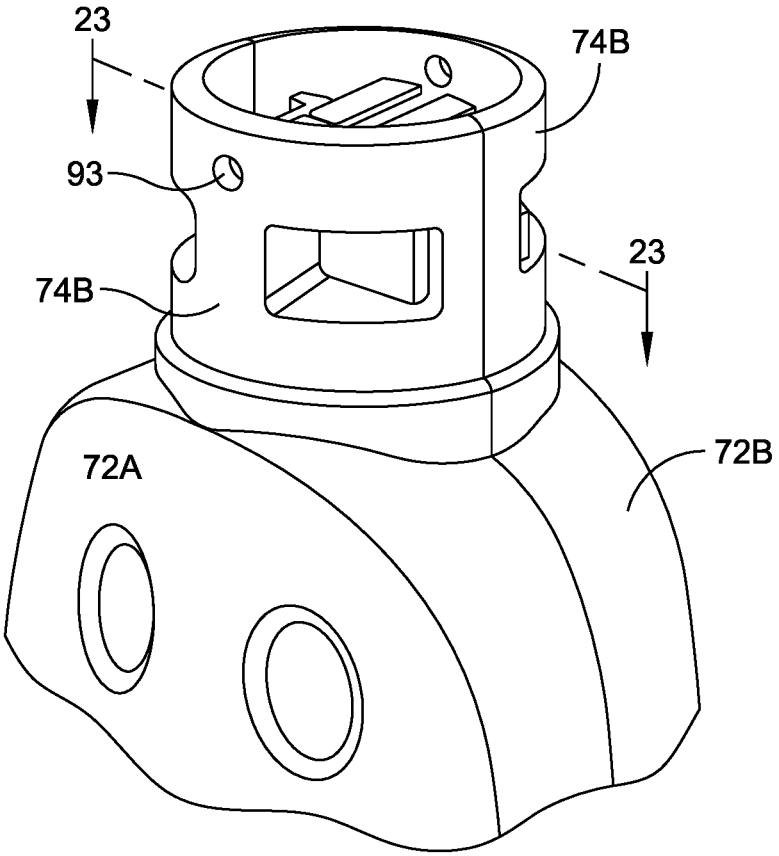
FIG. 21 is a fragmentary perspective view showing the shroud halves engaged.
Figure 22:
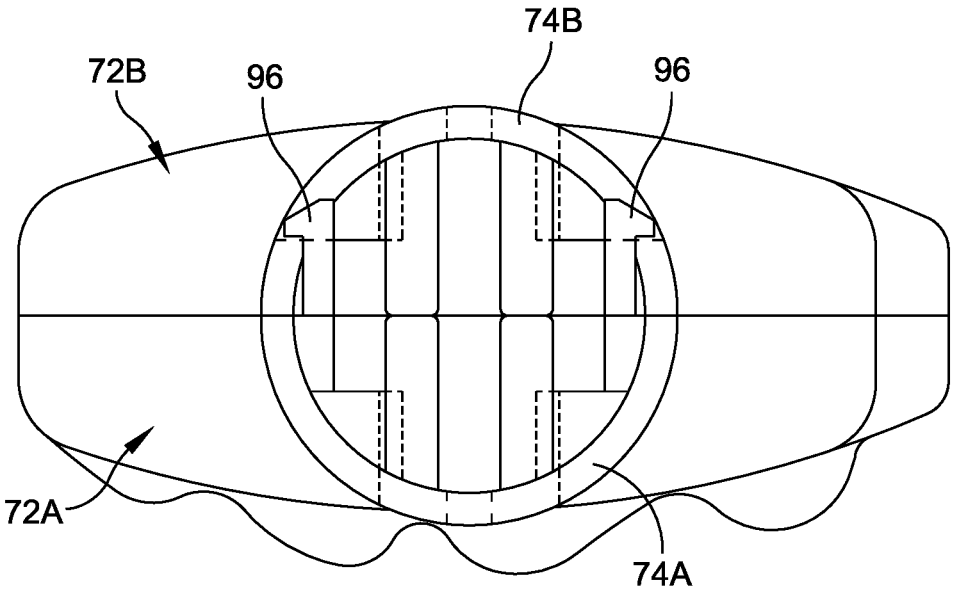
FIG. 22 is a plan view of FIG. 21.
Figure 23:
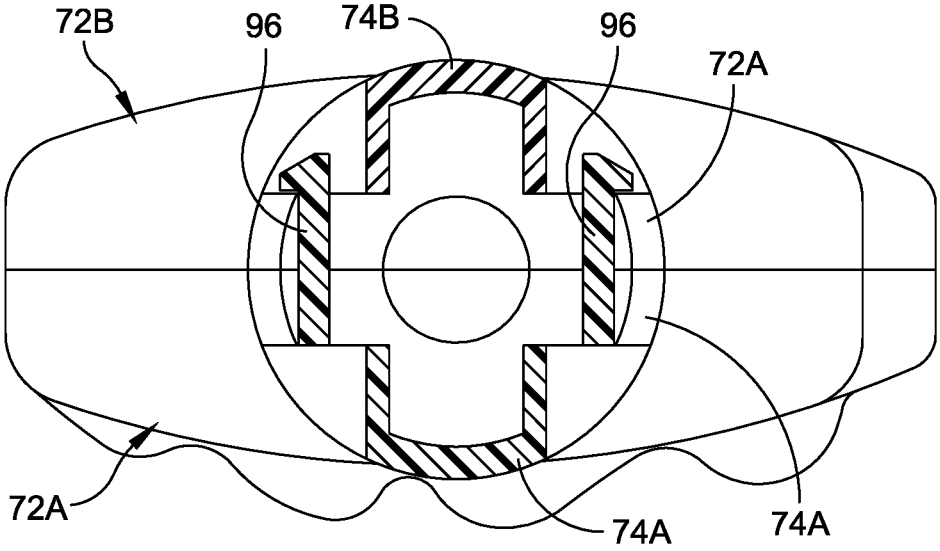
FIG. 23 is a cross-sectional view taken along line 23-23 of FIG. 21.
Figure 24:
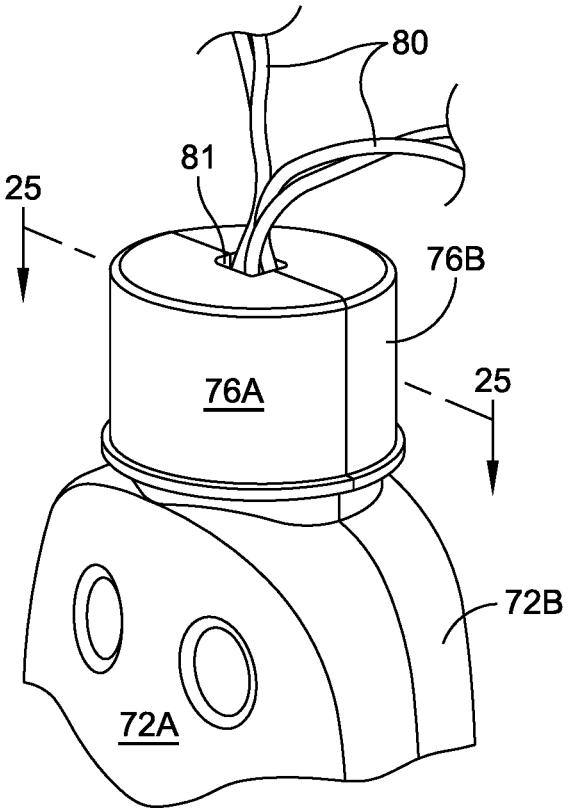
FIG. 24 is a fragmentary perspective view similar to that shown in FIG. 21 but with the cap halves engaged.
Figure 25:
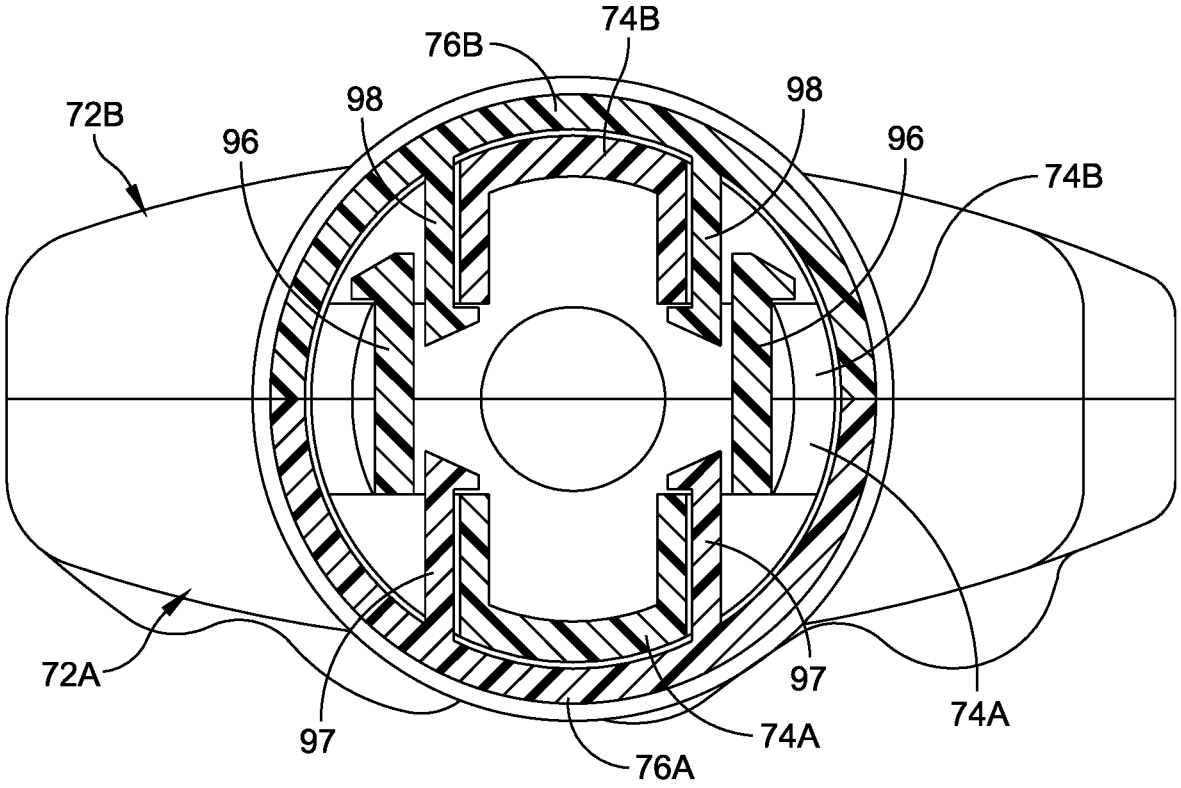
FIG. 25 is a cross-sectional view taken along line 25-25 of FIG. 24.

In the embodiment illustrated in FIGS. 18-25, each of the half is provided with a pair of longitudinally extending catch members. The cap half 76A is provided with a pair of catch members 97 while the cap half 76B is provided with a pair of spaced apart catch members 98. FIGS. 20-22 also illustrate an additional set of catch members 96. The catch members 96 are for engagement with a ledge associated with the shroud half 74B.

The catch members 97 and 98 are primarily used for the purpose of securing cap halves to respective neck portions 74A, 74B. FIG. 19 in particular shows a ledge at 98A to which the end of the catch members may engage. Refer also to the cross-sectional view of FIG. 25 that illustrates the catch members 97 engaged with a ledge of the shroud half 74A and a pair of catch members 98 that engage with the shroud half 74B. Thus, the catch members 96 are instrumental in securing the shroud halves together; that is along with the other interconnecting pieces 94, 95.

Having now described a limited number of embodiments of the present invention, it should now be apparent to those skilled in the art that numerous other embodiments and modifications thereof are contemplated as falling within the scope of the present invention, as defined by the appended claims.

What is claimed is:

1. A light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base and integral neck having a top surface through which the electrical wiring extends, the light element being supported so as to be disposed within the base of the shroud so as to illuminate the base of the shroud; wherein each light element is comprised of a light source and a support post for supporting the light source; and further including respective retaining collar halves at a bottom end of the neck and that are adapted to be joined in providing a complete retaining collar when the mated shroud halves are secured together, said retaining collar for fixedly holding the light source support post, and in turn the light source, in a fixed position within the shroud.

2. The light string of claim 1 wherein the electrical wiring extends into and out of the top surface of the neck of each shroud half.

3. The light string of claim 1 wherein the light source comprises a light emitting diode (LED).

4. The light string of claim 1 wherein the decorative base defines a light bulb shape.

5. The light string of claim 1 wherein the decorative base defines a ghost shape.

6. The light string of claim 1 wherein the decorative base defines a flamingo shape.

7. The light string of claim 1, further comprising a cap that secures the mated shroud halves together, the cap having a like slot through which the wiring extends into and out of.

8. A light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base half and integral neck half, wherein the respective neck halves define an open top end for receiving the electrical wiring therethrough, the respective neck halves being cylindrical and having an outer neck diameter, and further including a cap having an opening that is coaxial with the open top end of the neck halves through which the wiring extends, and wherein the cap is comprised of cap halves each engaged with each respective neck half, the respective cap halves being cylindrical and having an inner cap diameter, the inner cap diameter being greater than the outer neck diameter so that the respective cap halves engage and surround the respective neck halves.

9. The light string of claim 8 wherein the cap opening is a slot coaxial with the open top end of the respective neck halves through which the wiring extends.

10. The light string of claim 9 wherein each cap half engages with each neck half by means of a post and hole arrangement which firmly engages both cap halves with respective neck halves.

11. The light string of claim 9 wherein the cap secures the shroud halves together.

12. The light string of claim 9, wherein each base half has a contiguous surface that forms only a single opening through which the wiring extends into and out of when the shroud halves are mated together.

13. The light string of claim 8, wherein the decorative base defines a ghost shape or a light bulb shape.

14. The light string of claim 8, wherein the decorative base defines a flamingo shape.

15. A light string of ornamental pieces wherein each ornamental piece is comprised of electrical wiring that provides electrical power to a light element for each ornamental piece and a shroud that is comprised of mated shroud halves that are constructed and arranged to receive the electrical wiring and capture the light element therebetween, the shroud halves each formed with a decorative base half and integral neck half, and a cap that is configured to secure the two shroud halves together so that when mated together the light element is captured between the two shroud halves; and wherein each base half has a contiguous surface that forms only a single opening through which the wiring extends into and out of when the shroud halves are mated together.

16. The light string of claim 15, wherein the top surface of the neck defines an opening through which the electrical wiring extends into and out of.

17. The light string of claim 16, wherein the opening is defined by a like slot in the cap that together define the opening.

18. The light string of claim 15 wherein the respective neck halves define an open top end for receiving the electrical wiring therethrough, the respective neck halves being cylindrical and having an outer neck diameter, and further including a cap having an opening that is coaxial with the open top end of the heck halves through which the wiring extends, and wherein the cap is comprised of cap halves each engaged with each respective neck half, the respective cap halves being cylindrical and having an inner cap diameter, the inner cap diameter being greater than the outer neck diameter so that the respective cap halves engage and surround the respective neck.

19. The light string of claim 15 wherein the decorative base defines a ghost shape or a light bulb shape.

* * * * *